US007846080B2

(12) United States Patent
Boren

(10) Patent No.: US 7,846,080 B2
(45) Date of Patent: Dec. 7, 2010

(54) MACHINE AND METHOD FOR HEAD, NECK AND, SHOULDER STRETCHING

(76) Inventor: John P. Boren, 6567 Manorwood, Katy, TX (US) 77493

( * ) Notice: Subject to any disclaimer, the term of this patent is extended or adjusted under 35 U.S.C. 154(b) by 228 days.

(21) Appl. No.: 12/013,295

(22) Filed: Jan. 11, 2008

(65) Prior Publication Data

US 2008/0176714 A1 Jul. 24, 2008

Related U.S. Application Data

(60) Provisional application No. 60/880,162, filed on Jan. 12, 2007.

(51) Int. Cl.
*A63B 21/00* (2006.01)

(52) U.S. Cl. ..... 482/130; 482/142

(58) Field of Classification Search ..... 602/36, 602/33–35; 5/610, 611, 612, 613; 606/242–244; 482/10, 904, 44, 142
See application file for complete search history.

(56) References Cited

U.S. PATENT DOCUMENTS

| | | | | |
|---|---|---|---|---|
| 1,530,519 | A | 3/1925 | Remington | |
| 2,828,735 | A | 4/1958 | Thompson | |
| 2,831,482 | A * | 4/1958 | Cobb | 602/33 |
| 3,265,065 | A | 8/1966 | Jillson | |
| 3,640,520 | A | 2/1972 | Wieland et al. | |
| 3,695,256 | A | 10/1972 | Brower | |
| 3,709,217 | A | 1/1973 | Powers | |
| 3,741,200 | A | 6/1973 | Morin | |
| 3,771,518 | A | 11/1973 | Greissing | |
| 3,814,414 | A | 6/1974 | Chapa | |
| 3,868,103 | A | 2/1975 | Pageot et al. | |
| 3,926,182 | A | 12/1975 | Stabholz | |
| 4,111,414 | A | 9/1978 | Roberts | |
| 4,149,714 | A | 4/1979 | Lambert, Jr. | |
| 4,198,044 | A | 4/1980 | Holappa | |
| 4,200,279 | A | 4/1980 | Lambert, Jr. | |

(Continued)

FOREIGN PATENT DOCUMENTS

DE 76054 11/1893

(Continued)

OTHER PUBLICATIONS

Office Action dated Mar. 5, 2009 issued in U.S. Appl. No. 12/013,316.

(Continued)

*Primary Examiner*—Jerome Donnelly
(74) *Attorney, Agent, or Firm*—Gary L. Bush; Mark D. Shelley II; Andrews Kurth LLP

(57) ABSTRACT

A machine and method of stretching and exercising the human body, specifically the head, neck, and upper shoulder region. The machine employs three separate user-controlled actuators to allow the user to move and adjust her head, neck, and upper shoulders to almost limitless positions and with utmost precision, thereby effectively stretching and exercising the user's occipital region to achieve the desired comfort level. Because the user is in control of the precise actuator movements, and hence the exact positioning of her occipital region, the machine is much easier and safer to operate and more effective than other exercise and/or physical strengthening devices.

20 Claims, 4 Drawing Sheets

U.S. PATENT DOCUMENTS 4,211,426 A 7/1980 Motloch
4,322,071 A 3/1982 Lambert, Jr. et al.
4,337,050 A 6/1982 Engalitcheff, Jr.
4,372,551 A 2/1983 Yurdin
4,372,552 A 2/1983 Carlmark
4,372,553 A 2/1983 Hatfield
4,524,763 A 6/1985 Eberling, Jr.
4,593,909 A 6/1986 Anselmo et al.
4,628,910 A 12/1986 Krukowski
4,672,697 A 6/1987 Schürch
4,691,694 A 9/1987 Boyd et al.
4,725,056 A 2/1988 Rehrl et al.
4,768,783 A 9/1988 Engalitcheff, Jr.
4,834,365 A 5/1989 Jones
4,836,536 A 6/1989 Jones
4,845,987 A 7/1989 Kenneth
4,881,528 A 11/1989 Scott
4,890,604 A 1/1990 Nelson
4,911,106 A 3/1990 Goodwin
4,987,622 A 1/1991 Shockey
5,020,520 A 6/1991 Lawlis
5,042,796 A 8/1991 Jibril
5,048,541 A 9/1991 Haneline
5,094,249 A 3/1992 Marras et al.
5,105,803 A 4/1992 Burton
5,129,881 A 7/1992 Pope
5,147,287 A 9/1992 Jewell et al.
5,213,556 A 5/1993 Boren
5,242,347 A 9/1993 Keeton
5,263,913 A 11/1993 Boren
5,263,914 A 11/1993 Simonson et al.
5,308,359 A * 5/1994 Lossing ..... 606/242
5,324,247 A 6/1994 Lepley
5,354,251 A 10/1994 Sleamaker
5,409,452 A 4/1995 Aversano
5,474,086 A 12/1995 McCormick et al.
5,529,558 A 6/1996 Koenig
5,577,503 A * 11/1996 Bonutti ..... 600/415
5,595,192 A 1/1997 Tatum
5,688,212 A 11/1997 Walker
5,704,881 A 1/1998 Dudley
5,766,115 A 6/1998 Huang
5,860,899 A 1/1999 Rassman
5,868,691 A 2/1999 Vishnevsky
5,897,472 A 4/1999 Thulasingam
5,943,983 A 8/1999 Drew et al.
6,083,183 A 7/2000 Yang
6,146,317 A 11/2000 Prusick
6,202,230 B1 3/2001 Borders
6,458,060 B1 10/2002 Watterson et al.
6,551,214 B1 4/2003 Taimela
6,656,098 B2 12/2003 Hoffman
6,672,998 B2 1/2004 Cook
6,689,027 B1 2/2004 Gardikis, Jr.
6,749,548 B2 6/2004 Hoffman
6,790,194 B1 9/2004 Katane et al.
6,814,708 B1 11/2004 Jennings
6,817,363 B2 11/2004 Biondo et al.
7,070,548 B2 7/2006 Thonn, Jr.
7,097,628 B1 8/2006 Baune
7,125,167 B2 10/2006 Alakkat
7,125,370 B1 10/2006 Schaffner et al.
7,255,708 B2 8/2007 Kim et al.
7,311,645 B1 12/2007 Lynch
7,402,128 B2 7/2008 Thonn, Jr.
2002/0000008 A1 * 1/2002 Borders ..... 5/622
2002/0111257 A1 8/2002 Hur
2002/0183177 A1 12/2002 Hoffman
2003/0017925 A1 1/2003 Hoffman
2003/0087736 A1 5/2003 Carter et al.
2005/0181917 A1 8/2005 Dayal
2006/0019805 A1 1/2006 Heck
2006/0035769 A1 2/2006 Phillips
2006/0048785 A1 3/2006 Dalen et al.
2006/0074366 A1 4/2006 Ryan et al.
2007/0093367 A1 4/2007 Walton
2007/0157393 A1 7/2007 Gerlach
2008/0176716 A1 7/2008 Boren
2008/0176721 A1 7/2008 Boren
2008/0177211 A1 7/2008 Boren
2008/0269030 A1 10/2008 Hoffman et al.

FOREIGN PATENT DOCUMENTS

DE 19852183 A1 5/2000
FR 2502487 A 3/1981
JP 06054871 A 3/1994

OTHER PUBLICATIONS

Office Action dated Mar. 19, 2009 issued in U.S. Appl. No. 12/013,323.
Loredan Biomedical, Inc. LIDO Strength Training System, Advertisement, © 1992.
The ATM (Active Therapeutic Movement) Concept—A White Paper (undated).
Giammatteo, S.W., "Relevance of ATM with Neurologically Impaired Adults" BackProject Corporation, http://backproject.com/articles/articles_neuro_applicability.html, printed Nov. 29, 2005.
ATM2-MD (Mini-Door-Model), BackProject Corporation http://backproject.com/products/prod_ATM2_MD.html, printed Nov. 29, 2005.

* cited by examiner

MACHINE AND METHOD FOR HEAD, NECK AND, SHOULDER STRETCHING

CROSS REFERENCE TO RELATED APPLICATION

This application is based upon provisional application 60/880,162, filed on Jan. 12, 2007, the priority of which is claimed.

BACKGROUND OF THE INVENTION

1. Field of the Invention

This invention relates to a device or machine for stretching and exercising the human body. Specifically, the invention relates to a device or machine which incrementally moves, positions, and stretches the head, neck and upper shoulder region (i.e., the occipital region) of the human body.

2. Description of the Prior Art

Prior art devices for stretching the head, neck, and upper shoulder region of the human body have included both medical and non-medical devices. Purely medical devices typically include over-the-door and power-controlled traction devices. Non-medical devices have typically included gym-type stretching equipment including, but not limited to, gravity balls and Pilates machines. However, Pilates equipment, MedX exercise equipment, and other fitness-oriented exercise and stretching units are often uncomfortable, cumbersome, and/or difficult to operate.

The complexity in applying any of the aforementioned devices for stretching and unloading the head, neck and shoulders is that, while the user's position of comfort may be obtained by movement of the occipital region by only a few degrees, these prior art devices provide movement of the occipital region which cannot be precisely controlled. Thus, the movement is either less than the movement that provides the maximum benefit or greater than the movement required. The latter may actually exacerbate the discomfort of or even cause injury to the user. Furthermore, conventional physical therapy devices, which often require prescription, are also not arranged and designed for intricate movements. Instead, these conventional physical therapy devices typically incorporate an arbitrarily selected de-compressive force at a "one position-fits-all" angle.

The foregoing illustrates a few of the shortcomings of the prior art. As previously described, prior art stretching devices for physical therapy and/or conditioning have not provided multiple positional options for the user prior to application of stretching movement. Thus, a machine for stretching the head, neck and upper shoulders region of the human body is desired which provides precise and comprehensive control of occipital positioning to the user during use and application thereof.

3. Identification of Objects of the Invention

An object of the invention is to accomplish one or more of the following:

Provide a machine for stretching the head, neck, and upper shoulders region of the human body which moves and adjusts the user's head, neck, and upper shoulders in multiple directions relative to the user's torso;

Provide a machine for stretching the head, neck, and upper shoulders region of the human body which permits the user to precisely control the movement and adjustment of the user's head, neck, and upper shoulders while the user is using the machine; and Provide a machine for stretching the head, neck, and upper shoulders region of the human body which permits the user to precisely control the movement and adjustment of the user's head, neck, and upper shoulders relative to each other using three actuators that operate independently of each other.

Other objects, features, and advantages of the invention will be apparent to one skilled in the art from the following specifications and drawings.

SUMMARY OF THE INVENTION

An exercise machine and method are disclosed for stretching and unloading compressed components of the human frame, particularly compressed components of the head, neck, and upper shoulders region, for the purpose of relaxation and stress reduction. The machine of a preferred implementation has three separate user-controlled actuators that allow the user to move and adjust the user's head, neck, and upper shoulders in multiple directions and with utmost precision, thereby effectively exercising and stretching the user's occipital region to achieve the desired comfort level. Because the user is in control of the machine's precise actuator movements, and hence the exact positioning of her occipital region, the machine is much easier and safer to operate and more effective than other exercise and physical strengthening devices.

BRIEF DESCRIPTION OF THE DRAWINGS

The objects, advantages, and features of the invention will become more apparent by reference to the drawings which are appended hereto, and wherein by way of illustration and not limitation implementations of the invention are described, of which.

DESCRIPTION OF THE PREFERRED EMBODIMENTS OF THE INVENTION

Figure 1:
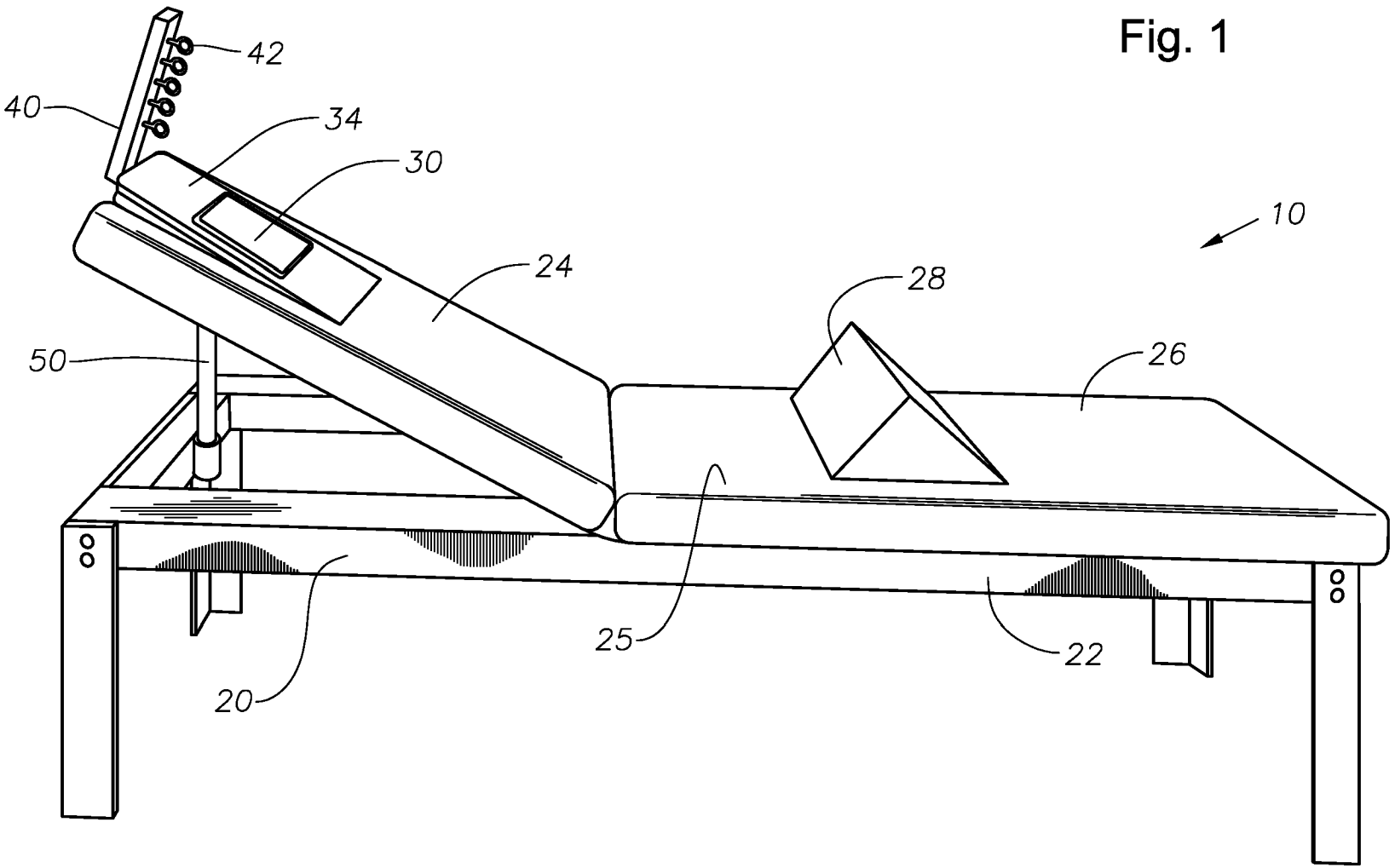
FIG. 1 illustrates a preferred implementation of the invention which has three separate user-controlled actuators that allow the user to move and adjust the user's head, neck, and upper shoulders in multiple directions and with precise positioning, thereby effectively exercising and stretching the user's occipital region to achieve the desired comfort level.

As generally shown in FIG. 1, a preferred implementation of the invention is a machine 10 which has three separate user-controlled actuators that allow the user to move and adjust the user's head, neck, and upper shoulders in multiple directions relative to her torso and with utmost precision, thereby effectively exercising and stretching the user's occipital region to achieve the desired comfort level. By moving and adjusting the user's head, neck, and upper shoulders relative to the user's torso and at a position angle that is most comfortable to the user, the machine 10 relaxes the user thereby reducing stress and providing a sense of well being. The machine 10 is much safer to operate than prior art devices, because the machine 10 is user-controlled and self-actuated and does not rely upon complicated computer controls, sophisticated motorization, and/or control by someone other than the user.

In a preferred implementation of the invention, as shown in FIG. 1, the machine 10 comprises a table 25, chair, bed, platform, or other rigid apparatus for supporting the human body in a supine position. The table 25 or other rigid apparatus is supported by two main frame sections, an upper frame section 20 and a lower frame section 22. The table 25 or other rigid apparatus has upper 24 and lower 26 table sections which are positioned above the upper 20 and lower 22 frame sections of the machine, respectively. Preferably, the upper 24 and lower 26 table section have cushions placed thereon or have cushioning to provide comfort to the user while the user is being supported by the machine in the supine position. The upper 20 and lower 22 frame sections of the machine provide structural support for the upper 24 and lower 26 table cushions/sections. An optional knee wedge 28 or similar device is positionally adjusted atop the lower table cushion/section 26 for supporting the lower half of the human body and to provide additional relaxation to the user while operating the machine 10. The user orients her body on top of the machine 10 with the upper half of her body atop the upper table cushion/section 24 of the machine and with the lower half of her body (i.e., her legs) draped over the optional knee wedge 28 positioned atop the lower table cushion/section 26 of the machine 10. The upper table cushion/section 24 has a head rest 30 or head cushion mounted thereon and provides the user with a place to rest her head while lying atop the machine 10. The head rest 30 or head cushion is positioned atop a head/occipital repositioning palate 34, which is an independently moveable portion of the upper table cushion/section 24. The user also wears a head harness, chin strap, or similar restraining device 32 about the head, as shown in FIG. 2C, which is capable of restraining the user's head without slippage. The head harness 32 is arranged and designed with an attachment device 38, such as a hook, eyelet, or grommet, disposed thereon so as to permit the user to operate the machine 10 in a supine position. While in operation, a strap, climbing clip, rope, chain or similar device 12 extends and connects between the head harness attachment device 38 and an upright projection 40 perpendicularly disposed above the upper end of the upper table cushion/section 24. The upright projection 40 is similar in shape to the tail of scorpion and has several hooks, eyelets, or similar devices 42 disposed at select intervals thereon for receiving and attaching the strap, climbing clip, rope, chain or similar device 12. The upright projection 40 is independently moveable from the upper table cushion/section 24 and is user-actuated to extend longitudinally outward and inward relative to the upper cushion/section 24. After the user's occipital region is fully restrained, the user may then adjust the upright projection 40 and/or the head/occipital repositioning palate 34 (and hence her occipital region relative to her torso) using a user-manipulated control, such as a joystick control or push button control (not shown). The user-manipulated control is preferably connected to three separate actuators 50, 52, 54 (FIGS. 2A-2C) which move and adjust the upper table cushion/section 24, head/occipital repositioning palate 34, and upright projection 40.

Figure 2A:
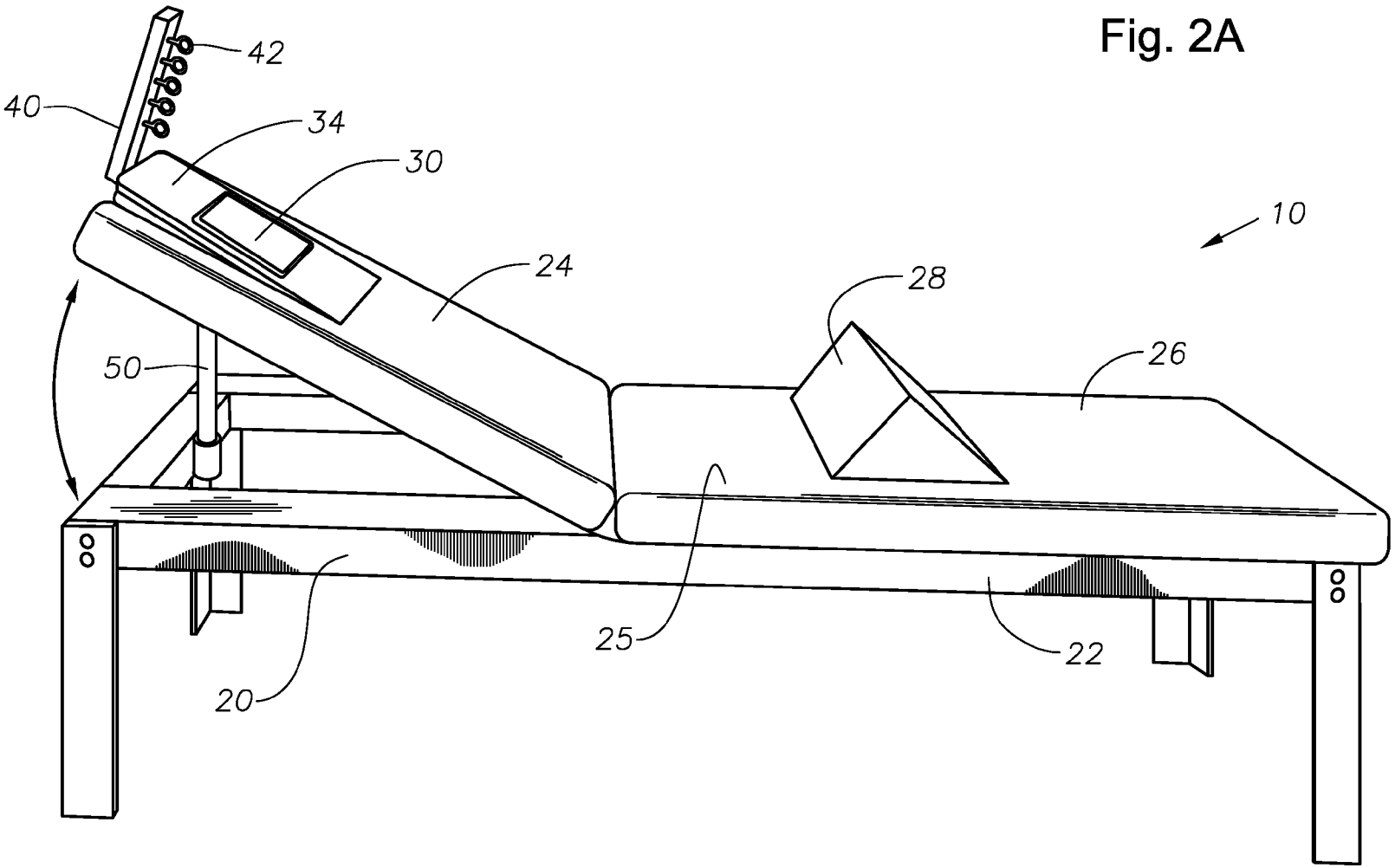
FIG. 2A illustrates a preferred implementation of the invention in which a table actuator raises one end of the table relative to the other end of the table to relieve positional stress and gravity on the pressure points in the head, neck, and upper shoulders.

As shown in FIG. 2A, a table actuator 50 controls the tilt, pivot, or elevation of the upper table cushion/section 24 relative to the lower table cushion/section 26 to relieve positional stress and gravity on the pressure points in the head, neck, and upper shoulders. Actuators and other powered mechanisms which move and manipulate physical objects relative to each other are well known in the art and thus will not be discussed at length herein. Likewise, control interfaces for actuators and similar mechanisms, which are operable by the user, are also well known in the art and include, but are not limited to, remote control devices, hard-wired devices, wireless devices, and voice command systems. The upper table cushion/section 24 is independently moveable and has an interior edge which attaches to and pivots about either the upper 20 or lower 22 frame sections of the machine 10. Alternatively, the upper table cushion/section 24 is independently moveable and has an interior edge which attaches to and pivots about the lower cushion 26. The table actuator 50 controls the pivot angle or tilt of the upper cushion 24. The table actuator 50 is arranged and designed to elevate the upper table cushion/section 24 above a purely horizontal position, thereby elevating the user's head, neck, and upper shoulders within a range of between 0 to 30 degrees above the user's horizontally-positioned lower body. The precise positioning of the upper table cushion/section 24 relative to the upper/lower frame sections 20, 22 (or the lower table cushion/section 26) is completely controlled by the user.

Figure 2B:
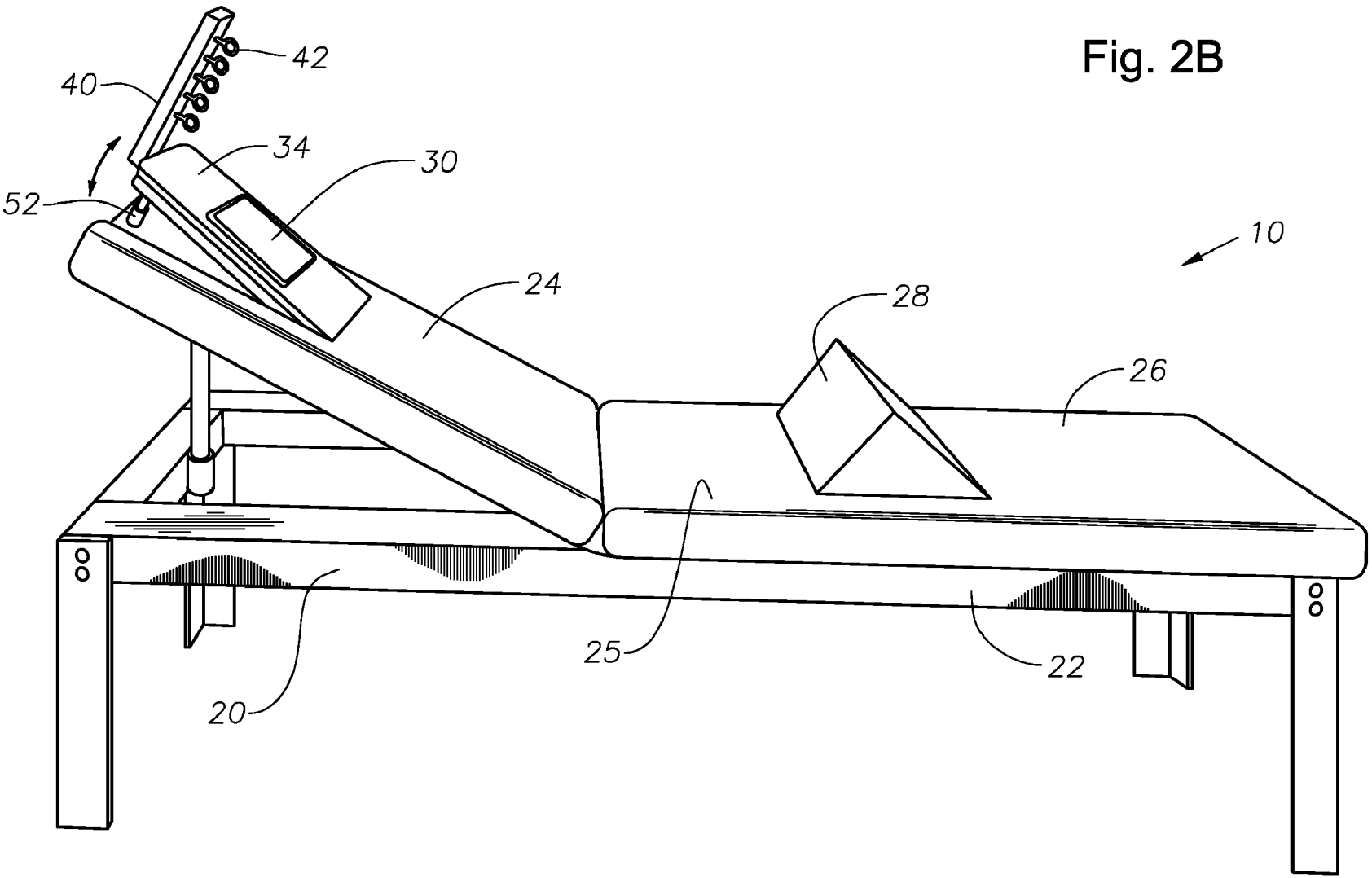
FIG. 2B illustrates a preferred implementation of the invention in which a palate actuator controls the upward tilt of the head/occipital repositioning palate (i.e., the head rest or head cushion) to relieve positional stress and gravity on the pressure points in the head, neck, and upper shoulders.
Figure 2C:
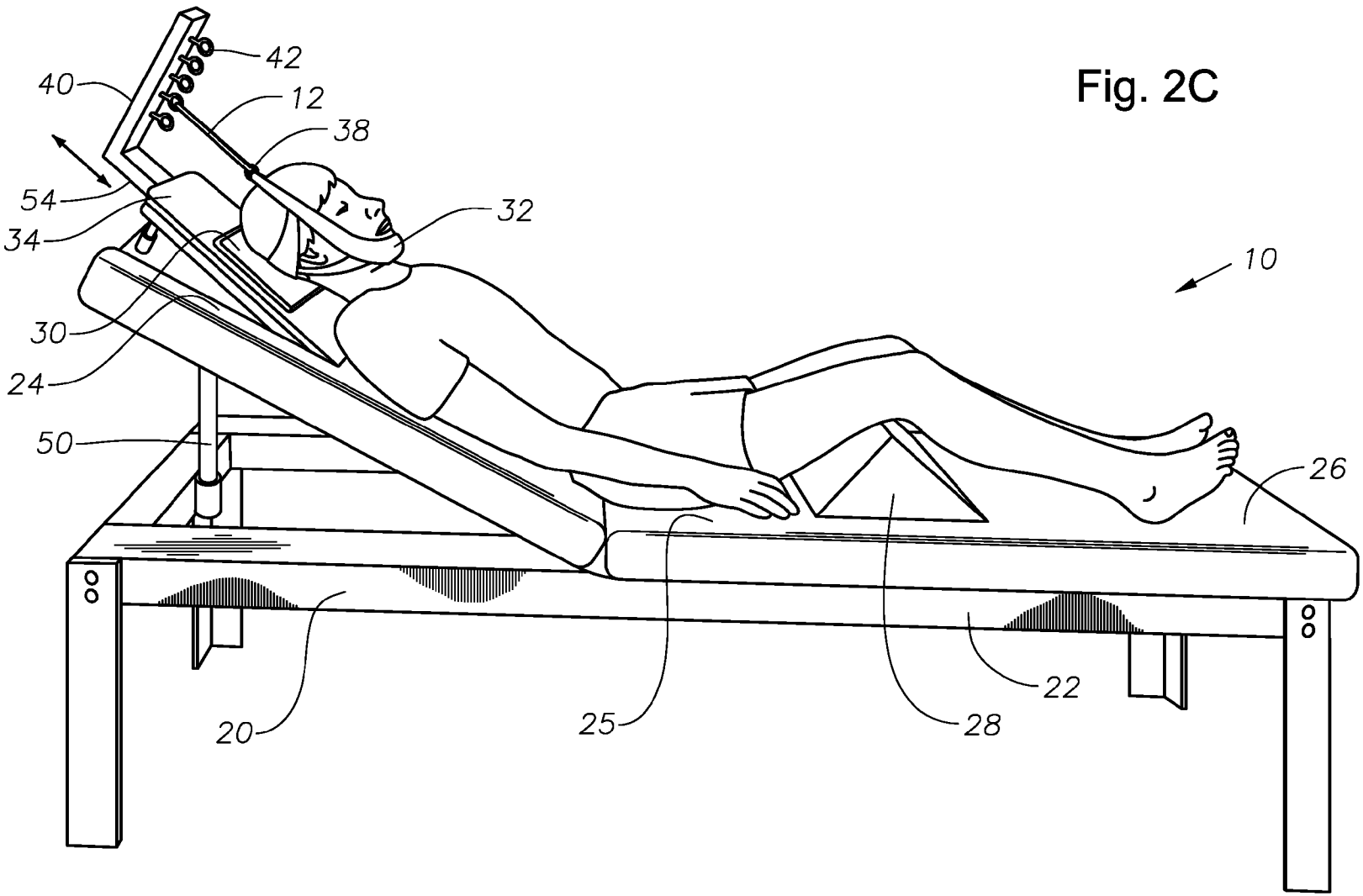
FIG. 2C illustrates a preferred implementation of the invention while in use in which an upright projection actuator controls the horizontal or outward movement of an upright projection away from the head/occipital repositioning palate such that a strap connected between the upright projection and a restraining device disposed above a user's head is drawn taut.

As shown in FIG. 2B, a palate actuator 52 controls the tilt, pivot, or elevation of the head/occipital repositioning palate 34 (i.e., the head rest 32 or head cushion) to relieve positional stress and gravity on the pressure points in the head, neck, and upper shoulders. As previously described, the head/occipital repositioning palate 34, upon which the head rest 32 or head cushion is disposed, is an independently moveable portion of the upper table cushion/section 24 that has an interior edge which attaches to and allows the head/occipital repositioning palate 34 to pivot about the upper table cushion/section 24. The palate actuator 52 controls the pivot angle or tilt of the head/occipital repositioning palate 34 (i.e., head rest 32 or head cushion). The palate actuator 52 is arranged and designed to elevate the head/occipital repositioning palate 34 above the surrounding upper table cushion/section 24 thereby elevating the user's head, neck, and upper shoulders within a range of between 0-90 degrees above the surrounding upper table cushion/section 24. The precise positioning of the head/occipital repositioning palate 34 (i.e., head rest 32 or head control) relative to the upper table cushion/section 24 is completely controlled by the user.

As shown in FIG. 2C, an upright projection actuator 54 controls the longitudinal outward or inward extension of the upright projection 40 beyond the upper table cushion/section 24. If the user's head is securely restrained to the upright projection 40 using the head harness 32 and strap 12, the user's head, neck, and upper shoulders are pulled away from the user's torso when the upright projection 40 is extended. As the upright projection 40 continues to be extended beyond the upper cushion 24, the user's head, neck, and upper shoulders are thus comfortably stretched and exercised. The precise extension and positioning of the upright projection 40 relative to the upper table cushion/section 24 is completely controlled by the user.

Thus, in a preferred implementation of the invention, the user is able to easily control the machine using three actuators 50, 52, 54 such that: (1) the user's upper body is moved and adjusted relative to the user's lower body, (2) the user's neck is moved and adjusted relative to the user's shoulders, and (3) the user's neck and upper shoulders are pulled and stretched away from the user's torso. The three actuators 50, 52, 54 are arranged and designed to each move and adjust the different components 24, 34, 40 of the machine 10 independently of each other and with minute precision. Therefore, the machine may be used to manipulate the head, neck, and upper shoulders to an extremely large number of positions for user-controlled unloading/stretching. In fact, the number of differing occipital positions that may be achieved using a preferred embodiment of the invention has been estimated to exceed 4,000 possible position combinations. Furthermore, self-actuation of the occipital stretching machine permits the user to self position her head, neck, and upper shoulders in such a way as to provide the greatest comfort and relaxation to the occipital region and to conduct the appropriate level of unloading/stretching thereof.

The Abstract of the disclosure is written solely for providing the United States Patent and Trademark Office and the public at large with a means by which to determine quickly from a cursory inspection the nature and gist of the technical disclosure, and it represents one implementation of the invention and is not indicative of the nature of the invention as a whole.

While some embodiments of the invention have been illustrated in detail, the invention is not limited to the embodiments shown; modifications and adaptations of the above embodiments may occur to those skilled in the art. Such modifications and adaptations are in the spirit and scope of the invention as set forth herein:

What is claimed is:

1. An exercise machine (10) for stretching a human occipital region comprising, a table (25) arranged and designed to support a user in a supine position, said table having a moveable upper section (24) which receives a user's upper body and a stationary lower section (26) which receives a user's lower body, said moveable upper section arranged and designed to pivot about an interior edge positioned adjacent to said stationary lower section of said table such that said moveable upper section may be pivoted to form an obtuse angle with said stationary lower section, an occipital repositioning palate (34) forming a portion of said moveable upper section, said palate arranged and designed to pivot about an interior edge with said moveable upper section such that said palate may be pivoted independently of said moveable upper section to form an obtuse angle therewith, an upright projection (40) disposed at an exterior edge of said palate and being arranged and designed to move longitudinally away from said palate, said upright projection extending above said palate and having a device (42) toward a distal end thereof for connecting a strap thereto, a restraining device (32) arranged and designed to be worn about a user's head, and a strap (12) having one end connected to said device of said upright projection and another end connected to said restraining device, whereby when said upright projection is moved longitudinally away from said palate, said strap connected to said upright projection is drawn taut between said restraining device and said upright projection while said user is supported by said table in a supine position and said restraining device is worn about said user's head.

2. The machine of claim 1 wherein, said upright projection is moved longitudinally away from said palate by an upright projection actuator (54) controlled by a user of said machine.

3. The machine of claim 2 wherein, said occipital repositioning palate is pivoted about said interior edge with said moveable upper section by a palate actuator (52) controlled by a user of said machine.

4. The machine of claim 3 wherein, said moveable upper section of said table is pivoted about said interior edge positioned adjacent to said stationary lower section by a table actuator (50) controlled by a user of said machine.

5. The machine of claim 4 wherein, said device of said upright projection for connecting a strap thereto is arranged and designed to permit connection of said strap at one of multiple locations along said upright projection toward said distal end.

6. The machine of claim 5 further comprising, a knee wedge (28) positioned on said stationary lower section for placement of a user's legs thereover while said user is supported by said table in a supine position.

7. The machine of claim 1 further comprising, a knee wedge (28) positioned on said stationary lower section for placement of a user's legs thereover while said user is supported by said table in a supine position.

8. The machine of claim 1 wherein, said occipital repositioning palate is pivoted about said interior edge with said moveable upper section by a palate actuator (52) controlled by a user of said machine.

9. The machine of claim 8 wherein, said moveable upper section of said table is pivoted about said interior edge positioned adjacent to said stationary lower section by a table actuator (50) controlled by a user of said machine.

10. The machine of claim 1 wherein, said moveable upper section of said table is pivoted about said interior edge positioned adjacent to said stationary lower section by a table actuator (50), said table actuator arranged and designed to be controlled by a user of said machine.

11. The machine of claim 1 wherein, said device of said upright projection for connecting said strap thereto is arranged and designed to permit connection of said strap at one of multiple locations along said upright projection toward said distal end.

12. An exercise machine (10) for stretching a human occipital region comprising, a table (25) arranged and designed to support a user in a supine position, said table having an upper section (24) which receives a user's upper body and a lower section (26) which receives a user's lower body, said upper section arranged and designed to pivot thereby elevating said user's upper body relative to said user's lower body, said upper section also including a portion at an upper end thereof arranged and designed to pivot independently of said upper section, an upright projection (40) disposed at said upper end of said upper section and being arranged and designed to move longitudinally away from said upper section, said upright projection extending above said upper section and having a device (42) toward a distal end thereof for attaching a strap thereto, a restraining device (32) arranged and designed to be worn about a user's head, and a strap (12) having one end attached to said device of said upright projection and another end attached to said restraining device, whereby when said upright projection is moved longitudinally away from said upper section, said strap attached to said upright projection is drawn taut between said restraining device and said upright projection while said user is supported by said table in a supine position and said restraining device is worn about said user's head.

13. The machine of claim 12 wherein, said upper section is arranged and designed to pivot about an interior edge positioned adjacent to said lower section of said table such that said upper section may be pivoted to form an obtuse angle with said lower section.

14. The machine of claim 13 wherein, said device of said upright projection for attaching a strap thereto is arranged and designed to permit connection of said strap at one of multiple locations along said upright projection toward said distal end.

15. The machine of claim 12 wherein, said device of said upright projection for attaching a strap thereto is arranged and designed to permit connection of said strap at one of multiple locations along said upright projection toward said distal end.

16. The machine of claim 12 further comprising, a knee wedge (28) positioned on said lower section for placement of a user's legs thereover while said user is supported by said table in a supine position.

17. An exercise method for stretching a human occipital region comprising the steps of, positioning a user on a table (25) arranged and designed to support said user in a supine position, said table having an upper section (24) which receives a user's upper body and a lower section (26) which receives a user's lower body, said upper section arranged and designed to pivot thereby clevating said user's upper body relative to said user's lower body, said upper section also including a portion at an upper end thereof arranged and designed to pivot independently of said upper section, disposing a restraining device (32) about a user's head, pivoting said upper section to elevate said user's upper body relative to said user's lower body, pivoting said portion at an upper end of said upper section to elevate said user's head relative to said upper section, attaching one end of a strap (12) to said restraining device and another end of said strap to an upright projection (40) disposed at said upper end of said upper section and extending thereabove, said upright projection having a device (42) toward a distal end thereof for attaching said strap thereto, moving said upright projection away from said upper section, and drawing taut said strap attached between said restraining device and said upright projection.

18. The method of claim 17 wherein, said step of moving said upright projection away from said upper section is enabled by an actuator (54) controlled by said user.

19. The machine of claim 12 wherein, said upper section is capable of being pivoted between zero to thirty degrees relative to a horizontal position.

20. The machine of claim 1 wherein, said movable upper section is capable of being pivoted between zero to thirty degrees relative to a horizontal position, thereby forming an obtuse angle of between 150 to 180 degrees with said stationary lower section.

* * * * *